United States Patent [19]

Honma

[11] Patent Number: 4,772,010

[45] Date of Patent: Sep. 20, 1988

[54] GUIDE MECHANISM FOR PAPER SHEETS IN AN ELEVATOR TYPE SORTER

[75] Inventor: Tomio Honma, Kawasaki, Japan

[73] Assignee: Duplo Seizo Kabushiki Kaisha, Tokyo, Japan

[21] Appl. No.: 32,480

[22] Filed: Mar. 30, 1987

[30] Foreign Application Priority Data

Dec. 5, 1986 [JP] Japan ..... 61-186757

[51] Int. Cl.[4] ..... B65H 39/10

[52] U.S. Cl. ..... 271/296; 271/299; 271/300; 271/200

[58] Field of Search ..... 271/296, 279, 287, 299, 271/300, 303, 200

[56] References Cited

U.S. PATENT DOCUMENTS

| | | | |
|---|---|---|---|
| 3,372,922 | 3/1968 | Snellman et al. | 271/296 |
| 3,561,753 | 2/1971 | Snellman | 271/296 X |
| 3,765,670 | 10/1973 | Johnson | 271/296 |
| 4,273,326 | 6/1981 | Snellman et al. | 271/296 X |
| 4,322,069 | 3/1982 | Mitchell | 271/296 |

*Primary Examiner*—Joseph J. Rolla
*Assistant Examiner*—David H. Bollinger
*Attorney, Agent, or Firm*—Christensen, O'Connor Johnson & Kindness

[57] ABSTRACT

A paper sheet guide mechanism is provided for use in a sorter of the elevator type. Paper sheets are conveyed from an input through the paper sorter along a conveyor belt and are successively deflected by an elevator for distribution on corresponding paper shelves. A guide mechanism includes a plurality of moveable wires which on one end are attached to the elevator and extend parallel to each other along a common plane toward the top of the sorter. These moveable wires pass over a plurality of pulleys and are thereby directed down a common side of the housing, around other pulleys, and are attached to a bracket that is connected to the bottom of the elevator in an endless loop. A tension spring is interposed in each of these wire loops. The plane formed by the parallel moveable wires is adjacent to and slightly closer to the inner ends of the paper shelves than is the plane along which paper is transported through the sorter by the conveyor belt. A plurality of fixed wires are disposed opposite the endless loop wires, and on the other side of the paper transport plane. Paper sheets are conveyed by the sorter conveyor belt between the fixed and the endless loop wires and are delivered to the appropriate paper shelves by the elevator as it moves up and down in the sorter housing.

1 Claim, 2 Drawing Sheets

GUIDE MECHANISM FOR PAPER SHEETS IN AN ELEVATOR TYPE SORTER

TECHNICAL FIELD

The subject invention generally relates to a guide mechanism for paper sheets being transported by a conveyor belt in an elevator type sorter and, more particularly, to such a mechanism using endless loops formed by a plurality of wires.

BACKGROUND OF THE INVENTION

In elevator type sorters of the prior art, a perforated belt and suction fan are usually employed to provide a suction effect to hold paper sheets against a conveyor belt as they are transported through the sorter. An alternative guide mechanism has also been used involving a plurality of ribbons that are connected to an elevator that moves up and down in the sorter column to deliver paper sheets to each shelf in the sorter. In this type guide mechanism, the ribbons are repeatedly wound and unwound by a plurality of take-up spools arranged on the ends of the sorter housing, as the elevator moves up and down.

Use of either the suction guide mechanism or the ribbon take-up guide mechanism results in a relatively complicated structure and correspondingly increased number of parts, both leading to an increased manufacturing cost. In view of these drawbacks, it is an object of the present invention to provide a guide mechanism for paper sheets in an elevator type sorter that is improved so as to significantly reduce the manufacturing costs. This and other objects of the invention will be apparent to those skilled in the art from the description of the preferred embodiment which follows hereinbelow and the attached drawings.

SUMMARY OF THE INVENTION

The present invention is intended for use in a sorter of the elevator type that includes a paper sheet conveyor belt extending along a direction which the paper sheets are to be delivered to a plurality of paper sheet shelves. The shelves are arranged one above the other and an elevator is adapted to be moved along a passage between the belt and the inner ends of the respective shelves so that paper sheets transported by the belt may be deflected by the elevator onto the appropriate shelf. The guide mechanism includes wire means for guiding the paper sheets, that are connected to the elevator to provide an endless loop; interposed in the loop is a tension spring. A sorter housing is provided on both sides of the loop with pulleys on which an intermediate portion of the wire means is hung. Pulleys located on a paper sheet inlet side of the sorter housing are arranged to have their axes substantially perpendicular to the plane in which paper sheets are transported by the conveyor belt through the sorter. The guide wire means thus define a plane that is adjacent the column of shelves, and which extends in the direction paper sheets are transported by the conveyor belt.

DETAILED DESCRIPTION OF THE PREFERRED EMBODIMENT

Figure 1:
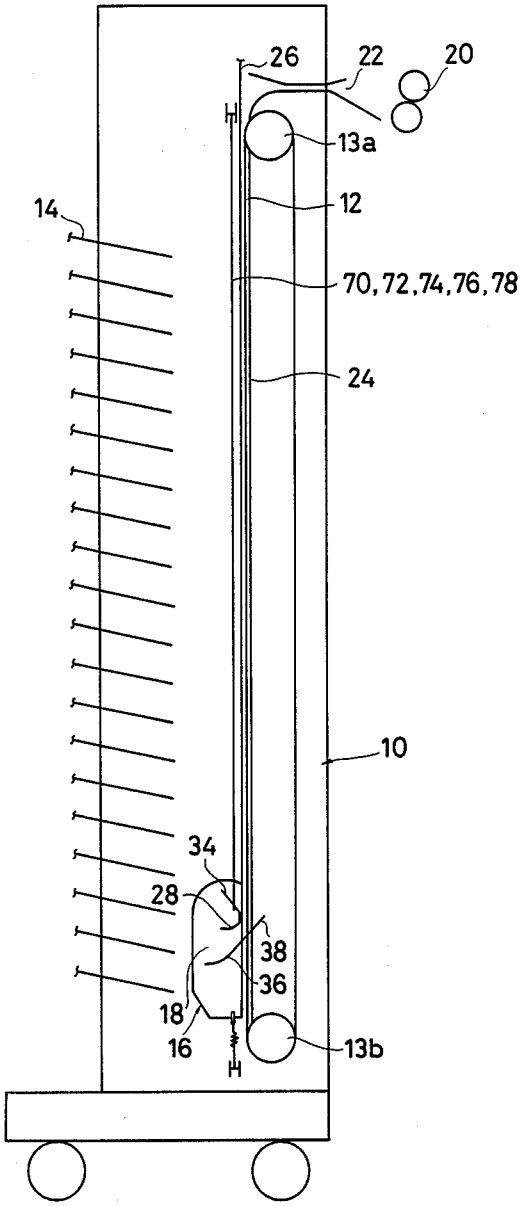
FIG. 1 is a schematic diagram illustrating an embodiment of an elevator type sorter to which the present invention is applied.

Referring to FIG. 1, an elevator type sorter is generally denoted by reference numeral 10. Sorter 10 is centrally provided with a vertically extending, endless flat belt 12 that is operative to convey paper sheets through the sorter. Belt 12 is supported at its upper and lower ends by pulleys 13A, 13B, and it is continuously rotated by a separate drive mechanism (not shown) in a counterclockwise direction as seen in FIG. 1. A plurality of paper sheet receiving shelves 14 are arranged one above the other; each of these shelves 14 is slightly inclined upwards from its inner end toward its outer end.

Between belt 12 and the inner ends of the respective shelves 14, there is provided an elevator 16. Separate control and drive mechanisms (not shown) cause elevator 16 to be intermittently moved from its upper end position to its lower end position in such a manner that it stops at a position corresponding to each shelf 14. Its movement to and from these positions is repeated as paper is sorted by sorter 10. Elevator 16 includes means that define a deflecting path 18 through which each paper sheet moves from the conveyor belt 12 to a shelf 14, and a plurality of pairs of paper delivery rollers 42, 44 for urging the sheets into the shelves as will be described later.

A pair of rollers associated with a source of the paper sheets to be sorted by sorter 10, e.g., a printer or copying machine is designated by reference numeral 20. Paper sheets from the source machine are delivered by rollers 20 through an inlet 22 and into sorter 10. The paper sheets thus delivered are transported along belt 12, and are deflected along path 18 every time elevator 16 stops at a position corresponding to an associated shelf 14, so that the paper sheet can be directed to the shelf and delivered by the pairs of delivery rollers 42, 44. Starting from its upper end position, elevator 16 is successively stopped at the positions corresponding to shelves 14 so that paper sheets are successively delivered one by one onto the respective shelves 14 and are thereby properly distributed.

Figure 2:
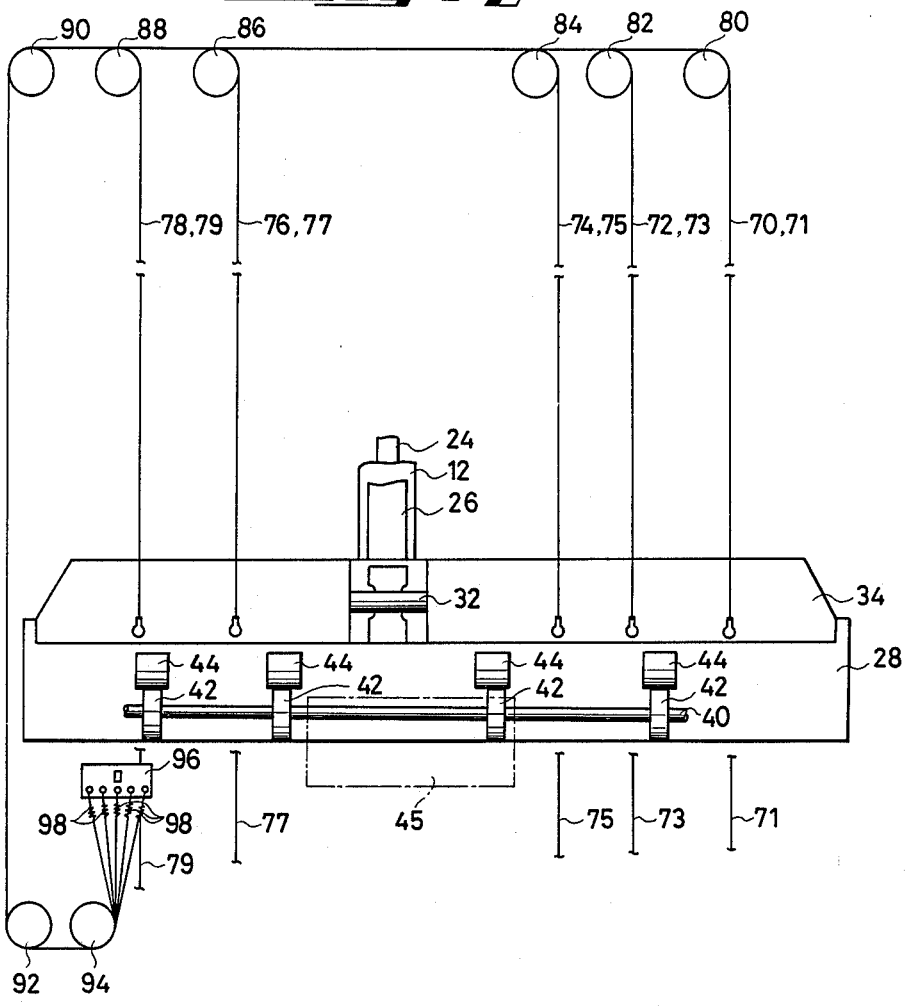
FIG. 2 is a front elevational view illustrating details of the relationship between the conveyor belt and the elevator.
Figure 3:
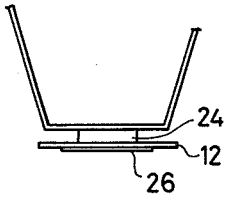
FIG. 3 is a plan view illustrating details of the conveyor belt.

Turning now to FIG. 2, the relationship between conveyor belt 12 and elevator 16 is illustrated in detail. There is provided behind conveyor belt 12 a magnetic strip 24 which is stationary relative to a housing of sorter 10, and vertically extends substantially along the distance through which elevator 16 can be moved. In front of conveyor belt 12, there is provided a steel ribbon 26 which is magnetically biased toward belt 12 by magnetic ribbon 24 (see FIG. 3). Paper sheets conveyed by belt 12 pass through a gap defined between belt 12 and steel ribbon 26.

Steel ribbon 26 has its upper end fixed to a frame member (not shown) provided within sorter 10 and its lower end attached to a shaft 32 which is, in turn, supported by upper frame 28 of elevator 16. Ribbon 26 has an elasticity such that it tends to take a spiral form whenever it is released in a free condition, and is adapted to be repeatedly wound and unwound, as elevator 16 is moved up and down.

Upper frame 28 of elevator 16 has an extension which serves as a guide 34 that is recurved leftwards as seen in FIG. 1. A lower frame 36 of elevator 16 has an extension that serves as a guide 38, extending right and upwards, as seen in FIG. 1. These guides 34, 38 together define the above-mentioned paper sheet deflecting path 18. Path 18 is provided at its outlet with a plurality of pairs of paper delivery rollers 42, 44 (see FIG. 2), of which driving rollers 42 are supported on a shaft 40 in lower frame 36 and driven rollers 44 are supported in upper frame 28. Driving rollers 42 are driven by a drive mechanism 45 mounted on elevator 16, so that they turn at the same velocity as the paper feed velocity of conveyor belt 12.

Wire means 70, 72, 74, 76 and 78 comprising three wires located on the right side and two wires located on the left side of conveyor belt 12, as seen in FIG. 2, are connected at one end to guide 34 that is associated with upper frame 28 of elevator 16. The positions at which the ends of the wire means are connected to guide 34 are adjacent to the shelves and are somewhat closer thereto than the plane along which paper is transported by the conveyor belt. The wire means extend in an endless fashion within the sorter housing as will be described later in greater detail, and the other ends thereof are connected together to a bracket 96 that is fixed to the lower frame 36 of elevator 16. The other ends of respective wire means 70, 72, 74, 76 and 78 are connected to bracket 96 with tension springs 98 interposed, by which means the respective wires are maintained under suitable tension.

Upper pulleys 80 through 88 and an upper collecting pulley 90, disposed on one side, are provided in the sorter housing at substantially the same level as pulley 13A. Likewise, a lower first pulley 92 and a lower second pulley 94 are provided on the lower portion of the sorter housing at substantially the same level as pulley 13B. The respective pulleys 80 through 94 have axes of rotation that extend substantially perpendicular to the plane in which paper sheets are conveyed through the sorter, and are adapted to be rotated in a common plane that is adjacent and closer to the shelves than that along which the paper sheets are transported by the conveyor belt.

The pulleys arranged on the paper inlet side, i.e., respective upper pulleys 80 through 88 are positioned to operate with wire means 70, 72, 74, 76 and 78, respectively, and are displaced with respect to the positions at which the wire means are connected to the elevator by a distance corresponding to their own radius. As a result, the wire means vertically extend on the paper inlet side of the sorter in a plane that is adjacent to and somewhat closer to the shelves that the paper transport plane (see FIG. 1). Upper collecting pulley 90 and the lower first pulley 92 are, as seen in FIG. 2, mounted on positions shifted over to clear the left end of elevator 16, so that respective wire means 70, 72, 74, 76 and 78, after passing over respective upper pulleys 80 through 88, may be guided together by said pulleys 90 and 92 laterally along the side of the elevator without interference as it moves from the upper portion to the lower portion of the sorter housing. Lower second pulley 94 is located below bracket 96 so as to guide wire means 70, 72, 74, 76 and 78 extending through lower first pulley 92, to bracket 96.

In alignment with and opposite wire means 70, 72, 74, 76 and 78 are provided five stationary wire means 71, 73, 75, 77 and 79 extending on the paper inlet side adjacent the paper transport plane. These stationary wire means vertically extend somewhat beyond the movable extent of elevator 16 and have their opposite ends secured to the frame of the sorter housing with tension springs interposed (not shown) by which means the stationary wire means are maintained under suitable tension.

In the above-mentioned guide mechanism for paper sheets, elevator 16 serves as part of each endless loop formed by each of wire means 70, 72, 74, 76 and 78 so that the respective wire means run on pulleys 80 through 94, respectively, as elevator 16 is vertically moved. The lengths of the respective wire means extending from pulleys 80 through 88 on the paper inlet side and respective stationary wire means 71, 73, 75, 77 and 79 that are opposed thereto, serve to guide the paper sheets transported along conveyor belt 12 from inlet 22 to elevator 16.

Although a sorter provided with a single conveyor belt 12 has been described hereinabove in association with the preferred embodiment of the present invention, it will be apparent to those skilled in the art that a sorter provided with a plurality of conveyor belts would not require the stationary wire means. The additional conveyor belts would instead serve as a backing guide to the moveable wire means.

The sorter which has been described above and illustrated in the accompanying drawings is of the upright type in which paper sheets are introduced at a point near the top. However, the present invention is equally applicable to a sorter of the type wherein paper sheets are introduced from the bottom, or a sorter of the lateral type wherein sheets are transported by a conveyor belt that runs horizontally. Sorters of these types can be visualized simply by suitably orienting the drawings.

These and other changes to the preferred embodiment as disclosed hereinabove will be apparent to those skilled in the art. Although the invention has been disclosed with reference to a preferred embodiment and modifications thereto, it is not intended that such disclosure should in any way limit the scope of the claims that follow hereinbelow.

The embodiments of the invention in which an exclusive property or privilege is claimed are defined as follows:

1. In a sorter of the elevator type that includes a paper sheet conveyor belt extending along a paper transport plane in which the paper sheets are transported, a plurality of paper sheet receiving shelves arranged adjacent each other along the direction in which the paper sheets are transported, and an elevator adapted to be moved along a passage defined between the belt and the inner ends of the respective shelves, so that paper sheets transported by the belt may be successively deflected by the elevator for distribution onto corresponding shelves, a guide mechanism for the paper sheets comprising:

wire means for guiding the paper sheets while they are transported by the conveyor belt, the wire means having ends connected to the elevator, and being mounted to form an endless loop that includes a tension spring interposed therein to maintain the endless loop taut;

a sorter housing having a paper sheet inlet side and a side opposite thereto, and including a plurality of pulleys on which an intermediate portion of said wire means is hung, said plurality of pulleys including a set of upper pulleys disposed inside the sorter housing on the paper sheet inlet side and a set of pulleys disposed inside the sorter housing on the side opposite;

said set of upper pulleys disposed on the paper sheet inlet side of the housing being arranged to have their axes substantially perpendicular to the paper transport plane, and being disposed in a common plane, along with the ends of the wire means that are connected to the elevator, so that a length of the wire means extending from said set of upper pulleys on the paper sheet inlet side to the elevator extends in a plane adjacent the shelves and in the direction of paper transport.

* * * * *